US005403139A

United States Patent [19]

Slivon et al.

[11] Patent Number: 5,403,139

[45] Date of Patent: * Apr. 4, 1995

[54] SLIDING LATCH MECHANISM FOR A CABINET DRAWER

[75] Inventors: George R. Slivon, Kenosha; Kenneth C. Happ, Burlington; Jack A. Parise; Charles H. Heiligenthal, both of Kenosha, all of Wis.

[73] Assignee: Snap-on Incorporated, Kenosha, Wis.

[ * ] Notice: The portion of the term of this patent subsequent to Feb. 14, 2012 has been disclaimed.

[21] Appl. No.: 11,985

[22] Filed: Feb. 1, 1993

[51] Int. Cl.[6] ..... A47B 88/00

[52] U.S. Cl. ..... 312/332.1; 312/319.1; 312/333

[58] Field of Search ..... 312/319.1, 330.1, 332.1, 312/333; 292/163, 175

[56] References Cited

U.S. PATENT DOCUMENTS

| | | | |
|---|---|---|---|
| Re. 28,280 | 12/1974 | Aleks . | |
| 1,453,121 | 11/1920 | Benner . | |
| 1,876,748 | 9/1932 | Rand, Jr. et al. | 312/332.1 |
| 1,897,080 | 2/1933 | Soper | 312/332.1 X |
| 1,934,347 | 11/1933 | Bales et al. | 312/332.1 X |
| 2,689,777 | 9/1954 | Wolters . | |
| 3,031,248 | 4/1962 | Jeeves | 312/333 X |
| 3,245,744 | 4/1966 | Olson . | |
| 3,252,746 | 5/1966 | Kafferlin et al. | 312/333 X |
| 3,450,453 | 6/1969 | Tazaki . | |
| 3,469,875 | 6/1969 | Ahlgren . | |
| 4,553,353 | 11/1985 | Simpson | 292/175 X |
| 4,653,820 | 3/1987 | Tazaki . | |
| 4,790,579 | 12/1988 | Maxwell et al. . | |

FOREIGN PATENT DOCUMENTS

| | | |
|---|---|---|
| 0511918 | 4/1992 | European Pat. Off. . |
| 204469 | 12/1981 | Taiwan, Prov. of China . |
| 214062 | 6/1982 | Taiwan, Prov. of China . |

OTHER PUBLICATIONS

Catalog of Lista International Corporation, cover and p. 17.
File Cabinet (photos of).
Drawer (photos of).
Equipto cabinet (photos of).
Bott cabinet (photos of).

*Primary Examiner*—Brian K. Green
*Attorney, Agent, or Firm*—Emrich & Dithmar

[57] ABSTRACT

The latch mechanism includes a drawer pull at the front of the drawer. Under the top flange of the drawer pull is a channel in which a latch bar is slidably movable from side to side. One end of the latch bar carries a hook which is spring loaded to its latched position. When it is desired to open the drawer, the user places his fingertips beneath the pull and against the latch bar and moves the slide bar to its unlatched position.

15 Claims, 1 Drawing Sheet

SLIDING LATCH MECHANISM FOR A CABINET DRAWER

BACKGROUND OF THE INVENTION

Cabinets with drawers are constructed so that each drawer either automatically latches when closed or requires positive operation of an actuator to be latched. Drawers in filing cabinets are usually of the former character, while drawers in rolling cabinets in the marketplace must be positively actuated to latch them closed. The present application deals with a latch mechanism that is placed in its latched position automatically when the drawer is closed. It should be understood that latch mechanisms are separate from key-operated locks that may be included in cabinets. This application deals with the former, not locks.

In most latch mechanisms, the actuator is pivoted or rotated between its latched and unlatched conditions. When the cabinet is of the rolling type, that is, it is moved from place to place on its rollers, such latch mechanisms tend to inadvertently open, particularly if the floor is uneven. Known mechanisms incorporating a sliding structure have an actuator which is grasped by the user at a particular point to open it. When the pull extends across the drawer, it is more difficult to use if the user is required to grasp it at only one point.

Certain known drawer latch mechanisms require the use of two hands, one to unlatch the mechanism and the other to grasp the drawer pull and open the drawer. Also, they are unsightly because their actuators are visible.

SUMMARY OF THE INVENTION

It is an important object of the present invention to provide a drawer latch mechanism which is less likely to inadvertently open when the cabinet in which it is used is rolled from one place to another.

Another object is to provide a drawer latch mechanism which the user can grasp at any point along its extent to open the drawer.

Another object is to provide a drawer latch mechanism which is substantially concealed by the drawer pull.

Another object is to provide a drawer latch mechanism which is arranged so that one hand can both unlatch the mechanism and pull the drawer open.

In summary there is provided a latch mechanism for a drawer of a cabinet including sidewalls, the drawer including an elongated drawer pull, the latch mechanism comprising a slide bar under the pull and slidable between latched and unlatched positions, a hook at one end of said bar, a keeper on the adjacent one of said sidewalls of the cabinet adjacent to said hook, the hook being arranged to engage the keeper when the slide bar is in its latched position and to be disengaged from said keeper when the slide bar is in its unlatched position.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF A PREFERRED EMBODIMENT

Figure 1:
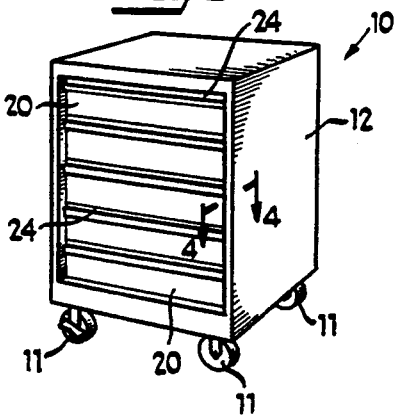
FIG. 1 is a perspective view of a cabinet containing a plurality of drawers.
Figure 2:
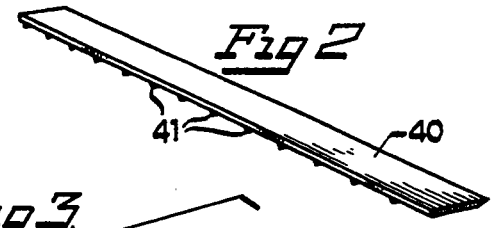
FIG. 2 a perspective view of the latch bar used in the drawer latch mechanism constructed in accordance with the features of present invention.
Figure 3:
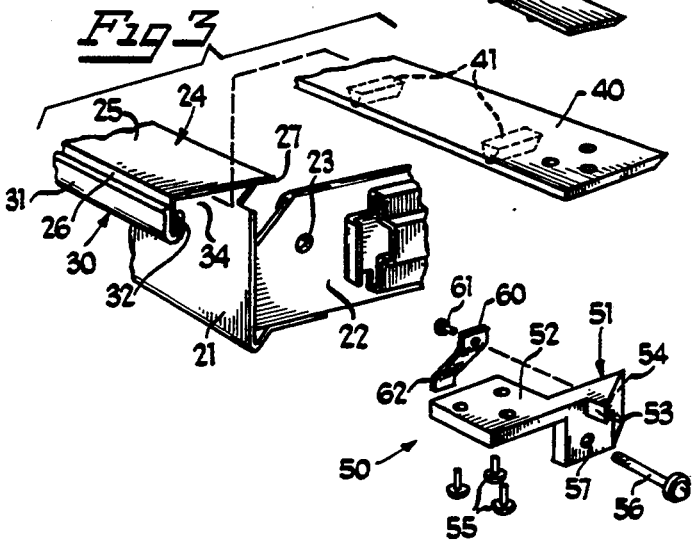
FIG. 3 is an exploded, perspective, fragmentary view, on an enlarged scale, of one of the latch mechanisms in the cabinet of FIG. 1.

Turning now to the drawings, and, more particularly, to FIG. 1 thereof, there is depicted a tool storage cabinet mounted on rollers 11. The cabinet 10 includes two sidewalls 12 and a plurality of drawers 20. An elongated metal drawer pull 24 is located at the front end of each of the drawers and extends along its entire length.

Referring to the rest of the drawings, each drawer 20 has a front wall 21 and a pair of sidewalls 22. The front of the one of the sidewalls 22 in which latching takes place has a hole 23. Each drawer has a pull 24 which is actually integral with front wall 21. Pull 24 includes a top flange 25 and a depending front flange 26. Front wall 21 is bent rearwardly at its upper end to form an offset portion 27.

Figure 6:
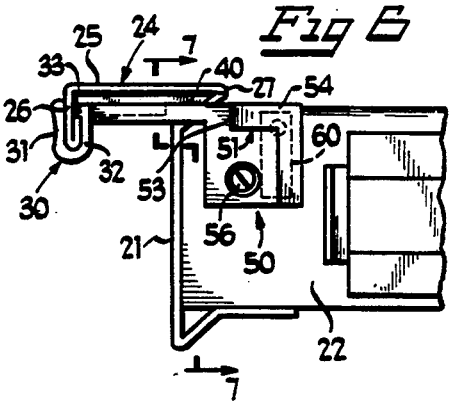
FIG. 6 is a view in vertical section taken along the line 6—6 of FIG. 4.

Associated with each drawer is a trim member 30 which is U-shaped in cross section, having a front element 31 and a rear element 32. Near the top of the rear element 32 is a forwardly projecting rib 33 (FIG. 6). Because of the convergence of elements 31 and 32 and their resilience, front flange 26 is tightly gripped between element 31 and rib 33. The space between rib 33 and top flange 25 at the front and the space defined by offset portion 27 at the rear, define a channel 34.

A latch bar 40 has a length substantially equal to the length of pull 24, a width slightly less than the width of top flange 25 and a thickness slightly less than the height of channel 34. Latch bar 40 carries a plurality of depending fingers 41, each of which, in the embodiment depicted, has a length less than the width of bar 40. Each finger 41 has a height to be engageable by a user's finger. Latch bar 40 is located in channel 34 and rests upon rib 33 at the front and offset portion 27 at the rear. Latch bar 40 is constrained between top flange 25, rib 33 and offset portion 27 and is horizontally slidable within channel 34 from side to side.

Each drawer also has a latch 50 which includes a hook 51 and an attachment flange 52. Hook 51 has a shoulder 53 and a camming surface 54. Fasteners 55 extend through holes in attachment flange 52 into holes in the end of latch bar 40, thereby attaching latch 50 thereto. Alternatively, bar 40 and latch 50 could be made integral and in one piece. A bolt 56 extends loosely through hole 57 in hook 51 and loosely through hole 23 in the adjacent side wall 22 of drawer 20. Bolt 56 is peened at 58 after assembly.

A leaf spring 60, which is depicted to be a metal strip in a flattened S-shape, has one end attached to hook 51 by means of a fastener 61 threaded into hook 51. The portion at the other end defines a knee 62 that contacts sidewall 22 of drawer 20. Other kinds of springs, such as a coil spring, could be used as well.

Figure 7:
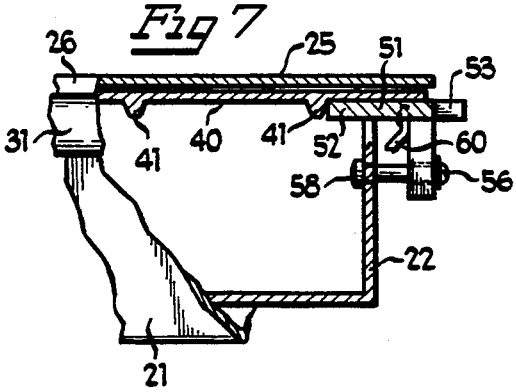
FIG 7 is a view in vertical section taken along the line 7—7 of FIG. 6.

Latch bar 40 is movable between latching and unlatching positions. Knee 62 contacts sidewall 22 thereby biasing bar 40 to the right, as viewed in FIG. 7 and to its latched condition. One may place one's fingers under drawer pull 24 and touch latch bar 40. By moving one's hand to the left, one or more depending fingers 41 are engaged and latch bar 40 is moved to the left to move it to its unlatched position.

Figure 4:
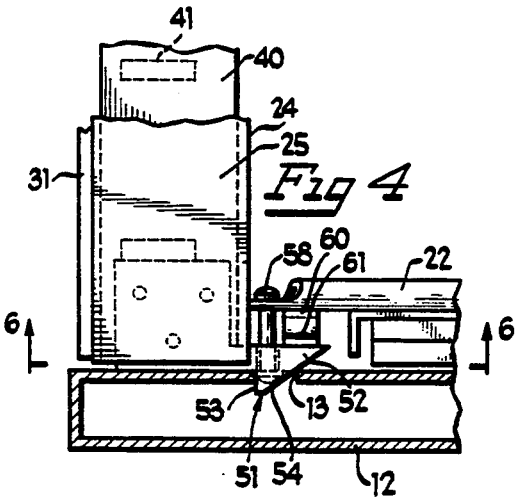
FIG. 4 is a sectional view of the latch mechanism in its latched condition, on an enlarged scale, taken along the line 4—4 of FIG. 1.

Referring to FIG. 4, whenever drawer 20 is in its closed position, hook 51 occupies the position shown, that is, it is in a keeper opening 13 of cabinet antepenultimate sidewall 12. Shoulder 53 is in facing relationship with the front of opening 13, thereby placing drawer 20 in its latched condition.

Figure 5:
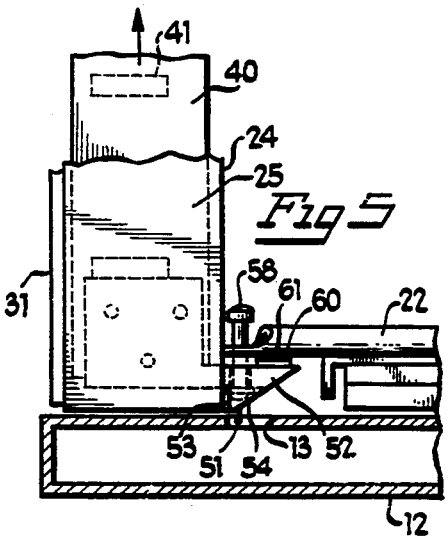
FIG. 5 is a view like FIG. 4, but with the latch mechanism in its unlatched condition.

When it is desired to open the drawer, the user places his fingers under pull 24 of the associated drawer whereby his finger tips will contact latch bar 40 as above described. Movement to the left will cause the finger tips to engage fingers 41 and move latch bar 40 to the left, causing hook 51 to be withdrawn from opening 13, as depicted in FIG. 5. Now the user, with his fingers against rear element 32 of trim member 30, pulls the drawer open. Latch bar 40 will automatically snap back to the right as soon as the user releases it, by virtue of spring 60 urging latch 50 to the right. When the drawer is later closed, camming surface 54 engages the front of the sidewall depicted, causing hook 51 to automatically move to the left thereby clearing sidewall 12, whereupon the drawer can be closed. Spring 60 will cause hook 51 to snap to the right, to the latched position depicted in FIG. 4.

Bolt 56 limits the extent to which latch bar 40 can move to the right. There are other ways to do that. For example, the other end of latch bar 40 can be formed with structure to limit the extent to which the latch bar moves to the right.

Cabinet 10 is on wheels and is adapted to be moved from place to place. It is important that, when the cabinet is being moved, the drawers be securely latched closed, so that they do not open inadvertently. The mechanism described above is secure. The bouncing motion which would occur if the floor on which the cabinet is being rolled is uneven would tend to unlatch a latch mechanism having an actuator that is pivoted vertically. Such bouncing would have much less of an effect on the horizontally movable latch bar described above. Moreover, the latch bar is concealed. It is not visible in FIG. 1 to spoil the cabinet's appearance. It is constrained by the drawer pull itself so that it is automatically engaged by the user who wants to open a drawer. The bar can be touched at any point along the drawer.

What is claimed is:

1. A cabinet comprising: a pair of spaced-apart side walls, a drawer disposed between said side walls, an elongated drawer pull fixed to said drawer having a front end and a rear end, a first support surface on said drawer adjacent to the rear end of said drawer pull and extending lengthwise thereof, means carried by the front end of said drawer pull defining a second support surface extending lengthwise of said drawer pull, an elongated slide member disposed externally of said drawer, said slide member being disposed under said drawer pull and extending longitudinally thereof and supported directly on said first and second support surfaces for sliding movement longitudinally thereof between latching and unlatching positions, a latch hook at one end of said slide member adjacent to one of said side walls, and a keeper on said one side wall adjacent to said drawer, said hook being engageable with said keeper when said slide member is in its latching position and being disengaged from said keeper when said slide member is in its unlatching position.

2. The cabinet of claim 1, wherein said slide member has a plurality of depending fingers.

3. The cabinet of claim 2, wherein said fingers are elongated and substantially parallel.

4. The cabinet of claim 3, wherein said slide member has a width, each of said fingers being shorter than the width of said slide member.

5. The cabinet of claim 1, and further comprising a spring biasing said slide member to its latched position.

6. The cabinet of claim 5, wherein said spring is attached to said hook.

7. The cabinet of claim 5, wherein said spring is a leaf spring.

8. The cabinet of claim 7, wherein said spring is in the form of a flattened S.

9. The cabinet of claim 5, wherein said hook includes a cam surface disposed for camming engagement with said one side wall when said drawer is moved from an open condition to a closed condition for moving said latch hook to its unlatching position against the urging of said spring.

10. The cabinet of claim 1, wherein said hook is discrete from and attached to said slide member.

11. The cabinet of claim 1, wherein said drawer pull includes a top flange and a depending front flange.

12. The cabinet of claim 11, wherein said slide member is disposed beneath said top flange.

13. The cabinet of claim 11, and further comprising an elongated trim member having front and rear elements receiving therebetween said front flange.

14. The cabinet of claim 13, wherein said rear element is spaced from said top flange and defines said second support surface, said slide member being located in said space.

15. The cabinet of claim 14, wherein said drawer pull has a rear end, and further comprising means at the rear end of said drawer pull for slidably supporting said slide member.

* * * * *